US008591098B2

(12) United States Patent
Kemp et al.

(10) Patent No.: US 8,591,098 B2
(45) Date of Patent: Nov. 26, 2013

(54) APPARATUS AND METHOD FOR MATERIAL BLENDING

(75) Inventors: Roger Kemp, Leawood, KS (US); Chris Kipp, Edwardsville, KS (US); Paul Kemp, Lee's Summit, MO (US); Andrew M. Nelson, Merriam, KS (US)

(73) Assignee: E-Loaders Company, LLC, Leawood, KS (US)

( * ) Notice: Subject to any disclaimer, the term of this patent is extended or adjusted under 35 U.S.C. 154(b) by 0 days.

(21) Appl. No.: 13/643,044

(22) PCT Filed: May 5, 2011

(86) PCT No.: PCT/US2011/035292

§ 371 (c)(1),
(2), (4) Date: Oct. 23, 2012

(87) PCT Pub. No.: WO2011/140297

PCT Pub. Date: Nov. 10, 2011

(65) Prior Publication Data

US 2013/0100760 A1 Apr. 25, 2013

Related U.S. Application Data

(60) Provisional application No. 61/331,590, filed on May 5, 2010.

(51) Int. Cl.
*B01F 15/02* (2006.01)
*B01F 15/04* (2006.01)

(52) U.S. Cl.
USPC ..... 366/160.1; 366/162.1; 366/163.1; 366/182.4

(58) Field of Classification Search
USPC ..... 366/160.1, 163.1, 163.2, 182.1, 182.3, 366/182.4; 406/12, 22, 127, 130
See application file for complete search history.

(56) References Cited

U.S. PATENT DOCUMENTS 3,135,294 A * 6/1964 Huber ..... 137/625.61
3,627,555 A * 12/1971 Driscoll ..... 106/472

(Continued)

FOREIGN PATENT DOCUMENTS

WO 2009/080880 A1 7/2009

OTHER PUBLICATIONS

Maguire Products Inc. 100 Series Weigh Scale Blender product literature, printed from internet Apr. 28, 2010, 5 pages.

(Continued)

*Primary Examiner* — Tony G Soohoo
(74) *Attorney, Agent, or Firm* — Hovey Williams LLP

(57) ABSTRACT

A material blender and method for blending a plurality of ingredient materials to make a single heterogeneous material. The material blender may comprise a blending apparatus, a control system, and a pneumatic delivery system. The pneumatic delivery system may comprise a plurality of conduits each provided with a pneumatic flow therethrough to pneumatically convey one of the ingredient materials to the blending apparatus. The delivery system may also comprise one or more valves configured to independently vary the pneumatic flow through one of the conduits. The control system may be configured to provide signals to the valves, commanding the valves to oscillate between varying degrees of openness based on a desired percentage or ratio of each of the ingredient materials to be output to the blending apparatus. The control system may calculate signals to send to the valves based on stored calibration information.

10 Claims, 5 Drawing Sheets

(56) References Cited

U.S. PATENT DOCUMENTS

| | | | | |
|---|---|---|---|---|
| 3,806,001 | A * | 4/1974 | Pratt | 222/132 |
| 3,870,375 | A * | 3/1975 | Duncan et al. | 406/127 |
| 4,430,001 | A * | 2/1984 | Schurr | 366/107 |
| 4,501,518 | A * | 2/1985 | Smith | 406/25 |
| 4,524,804 | A * | 6/1985 | Goedecke et al. | 137/625.64 |
| 4,718,795 | A * | 1/1988 | Dugge | 406/30 |
| 4,770,611 | A * | 9/1988 | Heyl | 417/147 |
| 4,801,210 | A * | 1/1989 | Gian | 366/156.2 |
| 4,850,703 | A * | 7/1989 | Hanaoka et al. | 366/160.1 |
| 5,083,872 | A * | 1/1992 | Farling et al. | 366/138 |
| 5,718,507 | A * | 2/1998 | Gian | 366/131 |
| 5,813,801 | A * | 9/1998 | Newbolt et al. | 406/14 |
| 6,170,768 | B1 | 1/2001 | Harmon et al. | |
| 6,486,481 | B1 | 11/2002 | Tigera | |
| 7,101,120 | B2 | 9/2006 | Jurkovich | |
| 8,360,691 | B2 * | 1/2013 | Moretto | 406/17 |
| 2002/0066746 | A1 * | 6/2002 | Sanders | 222/1 |
| 2005/0038557 | A1 * | 2/2005 | Friel et al. | 366/160.1 |
| 2005/0078550 | A1 * | 4/2005 | Landers | 366/158.1 |
| 2007/0092380 | A1 | 4/2007 | Fulkerson et al. | |
| 2010/0220548 | A1 * | 9/2010 | Freeman et al. | 366/152.3 |
| 2010/0331590 | A1 * | 12/2010 | Majumder et al. | 585/315 |

OTHER PUBLICATIONS

Maguire Products Inc. GlassVu Loaders product literature, printed from internet Apr. 28, 2010, 4 pages.

Maguire Products Inc. MicroBlender product literature, printed from internet Apr. 28, 2010, 5 pages.

Maguire Products Inc. Loaders product literature, printed from internet Apr. 28, 2010, 4 pages.

* cited by examiner

APPARATUS AND METHOD FOR MATERIAL BLENDING

RELATED APPLICATIONS

The present utility patent application claims priority benefit, with regard to all common subject matter, of the earlier-filed U.S. provisional patent application titled "Ratio Metric Blender" Ser. No. 61/331,590, filed May 5, 2010, hereby incorporated in its entirety by reference into the present application.

BACKGROUND

1. Field

The present invention generally relates to material blenders, and more specifically to automated loading of a desired amount of each material into a material blender.

2. Prior Art

Mixers and blenders are used in the plastics industry for processing chemicals in a normal state of pelletization. This may include natural material, regrind material, and colorant or other additives. Regrind material may be natural material which has been put through a granulator (also known as a grinder) after being processed into a part. For example, the part may have been rejected by quality control and can be turned into regrind material and re-processed if it is thermoplastic material. The colorant and additives in pellet form can be added to the natural and/or regrind material to change the chemical characteristics of the natural and/or regrind material. Colorant gives the part its color. An example of an additive may be a UV stabilizer added to the material to provide ultraviolet protection to the part so it does not fade or degrade in the sun.

It is normal in most manufacturing plants for processing machines to use natural material and to add a percentage of regrind material to it, typically 10 to 30 percent. Colorant added to the natural material may typically be about 1 to 10 percent and additives may typically be about 1 to 10 percent of the total resulting heterogeneous mixture. Accuracy for the recipe of mixing these materials is important, as these materials can be very expensive. Furthermore, if the parts made from these materials do not meet specifications, the parts are rejected, resulting in lost productivity and profitability.

Most manufactures use one of the following methods for adding regrind, colorant, and additive materials to natural material or feed stock: volumetric blending or weight-based blending. Volumetric blending determines the volume of each ingredient required based on percentages of a total volume to be produced. The equipment for this method is not very expensive, but it is also not very accurate. Often more colorant and additives must be added to make good parts than are called for in the material recipe. Accuracy for the volumetric blending method may be limited to plus or minus several full percentage points, due to variations in shape, size, density, and/or weight of the different materials being blended.

The weight-based blending method uses weigh scales or gravimetric blenders, with a greater resulting accuracy than the volumetric blending method. For example, the accuracy of the weight-based blending method may be plus or minus approximately 0.1% for additives and plus or minus approximately 1% for regrind. The gravimetric mixers often use load cells which have to be calibrated with bins set on top of them for holding each of the materials. The load cell gravimetric mixer is complex, large, and expensive, including bins, doors to the top of bins, doors at the bottom of bins, actuators to open doors of the bins, augers to feed materials to the bins, rotating blades on a shaft under the bins to mix materials, etc. Furthermore, if the mixed materials are conveyed directly from the gravimetric mixers to subsequent processing machines, the material may segregate due to different weight, density, and size, resulting in inconsistent parts that do not meet specifications. The vibration of the manufacturing floor can also cause load cells to come out of calibration, resulting in a loss of accuracy and the need for time-consuming re-calibration. Loading the gravimetric blender can also be a time-consuming, labor-intensive process. Automatic loaders are either purchased separately for loading materials into existing gravimetric loaders, or an operator loads the materials manually.

Therefore, there is a need for an improved method of material blending which does not suffer from the limitations of the prior art.

SUMMARY

Embodiments of the present invention relate to a material blender for blending a plurality of ingredient materials to make a heterogeneous material. The material blender may comprise a blending apparatus, a pneumatic conveying system, and a control system. The blending apparatus may have a plurality of inlets and an outlet formed therethrough. The pneumatic conveying system may have a plurality of conduits and flow control elements configured for pneumatically conveying the ingredient materials to the blending apparatus via the inlets. The control system may be electrically coupled to the pneumatic conveying system and configured to command at least one of the flow control elements to oscillate a pneumatic flow in one of the conduits at intervals calculated based on desired ratios or percentages of at least one of the ingredient materials.

The pneumatic conveying system may specifically include pneumatic accelerators communicably coupled with the conduits and configured to pull materials into the conduits to be pneumatically conveyed to the blending apparatus. Furthermore, the flow control elements may comprise valves communicably coupled to at least one of the pneumatic accelerators, wherein at least one of the valves is configured to vary pneumatic flow provided to the pneumatic accelerators and conduits. In this embodiment of the invention, the control system may be electrically coupled to the valves and configured to command at least one of the valves to oscillate between varying degrees of openness at intervals determined by the control system based on desired ratios or percentages of each of the one or more materials and based on calibration information accessible by the control system.

Some embodiments of the present invention comprise a method for automated blending of a plurality of ingredient materials, including at least a first ingredient material and a second ingredient material, to produce a single heterogeneous material. The method may comprise the steps of receiving or accessing at least one value corresponding to at least one of a desired ratio of the first ingredient material and a desired ratio of the second ingredient material to be blended. The method may further comprise sending a first signal to a first pneumatic conveying element, thereby commanding the first pneumatic conveying element to pneumatically convey the first ingredient material to a blending apparatus at a substantially constant rate. The method may further comprise sending a second signal to a second pneumatic conveying element, thereby commanding the second pneumatic conveying element to pneumatically convey the second ingredient material to the blending apparatus by oscillating a pneumatic flow therein at a rate corresponding to the desired ratio of the second ingredient. These steps may be performed by a control system.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

BRIEF DESCRIPTION OF THE DRAWING FIGURES

Embodiments of the present invention are described in detail below with reference to the attached drawing figures, wherein.

Figure 1:
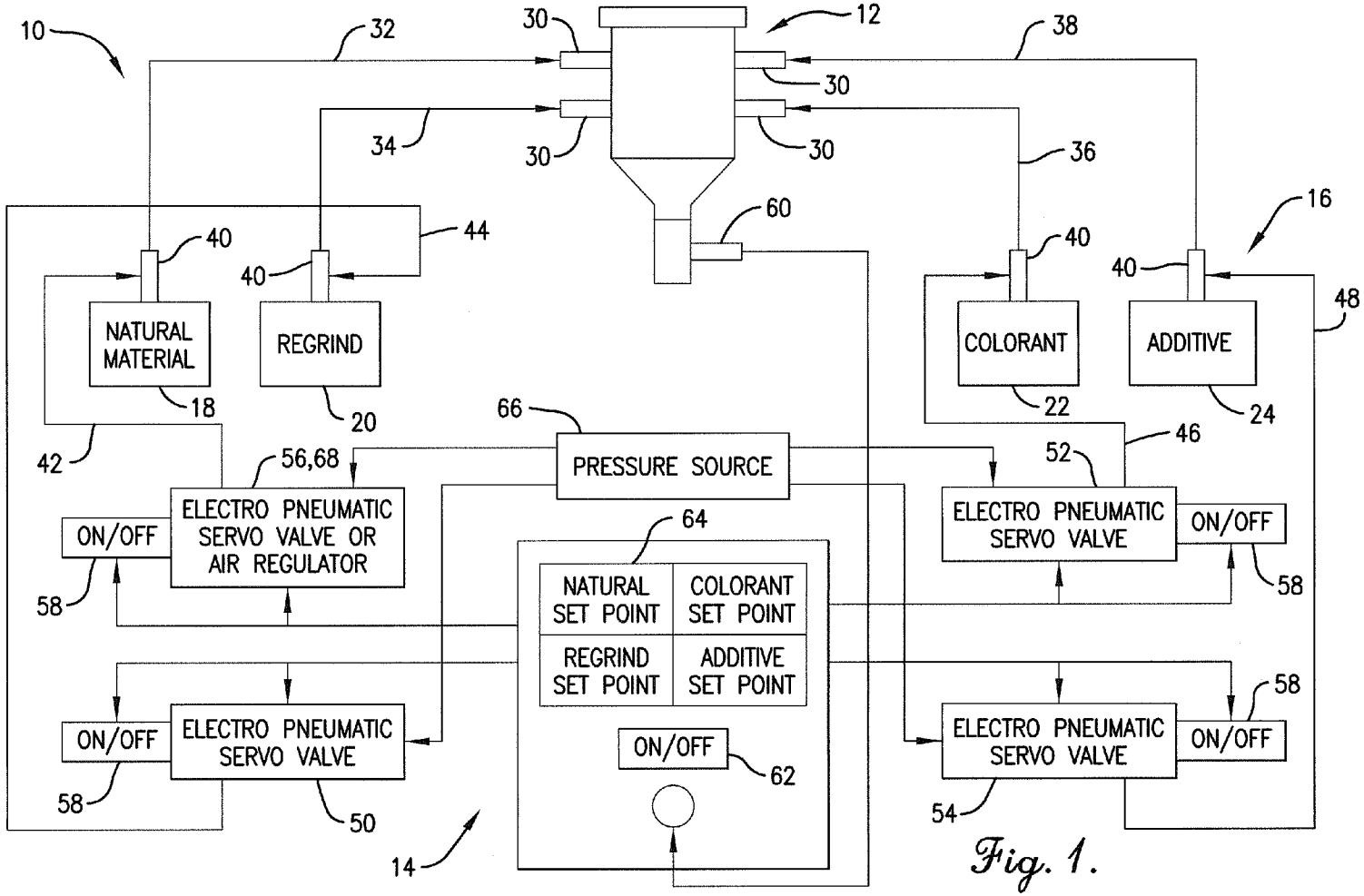
FIG. 1 is a schematic diagram of a material blender constructed in accordance with embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

The present invention, as illustrated in FIG. 1, provides a material blender 10 for blending a plurality of ingredient materials to make one heterogeneous material or heterogeneous blend. The material blender 10 may comprise a blending apparatus 12, a control system 14, and a delivery system 18 configured for delivering various materials to the blending apparatus 12 according to commands received by the control system 14.

The material blender 10, as defined herein, may be an apparatus configured for blending any plurality of ingredient materials in such a manner as to create a consistent or even blend of heterogeneous material. Specifically, the material blender 10 may be configured to blend materials in the form of particles, pellets, or granules. For example, the materials may comprise native plastics, regrind, colorant, and various other additives and materials used in the plastics processing industry. Specific types of plastic may include, for example, high density polyethylene or various other synthetic resins. Alternatively, the materials may be agricultural materials such as feed, fertilizer, and agrichemicals. In other alternative embodiments of the invention, the materials may be pharmaceuticals, glues and adhesives, minerals, chemicals, rubber, and/or food processing materials. However, other materials not listed herein may also be used without departing from the scope of the invention.

As illustrated in FIG. 1, the material blender 10 may also comprise or may access bins 18,20,22,24 comprising the materials. The materials in the bins may be referred to herein as ingredient material, while the resulting material output from the blending apparatus 12 may be referred to as the blended material or heterogeneous material. The bins 18-24 may include a native or natural material bin 18. The natural material, as referenced herein, generally means any material that is new or previously unused, and may be a synthetic resin in particle, pellet, or granular form. Furthermore, the bins 18-24 may include a regrind material bin 20. Regrind material, as referenced herein, generally means any material that was previously processed or partially processed and grinded, smashed, or otherwise broken into smaller pieces, such as a particle, pellet, or granular form. The bins 18-24 may also include a colorant bin 22 and an additive bin 24. Colorant may be any sort of dye, ink, stain, or color-imparting substance in particle, pellet, or granular form. Additives may be any additional materials to be blended into the heterogeneous material. For example, additives may be an ultraviolet (UV) stabilizer added to provide UV protection to a part being formed with the heterogeneous material, to minimize fading and degrading cause by the sun.

Figure 2:
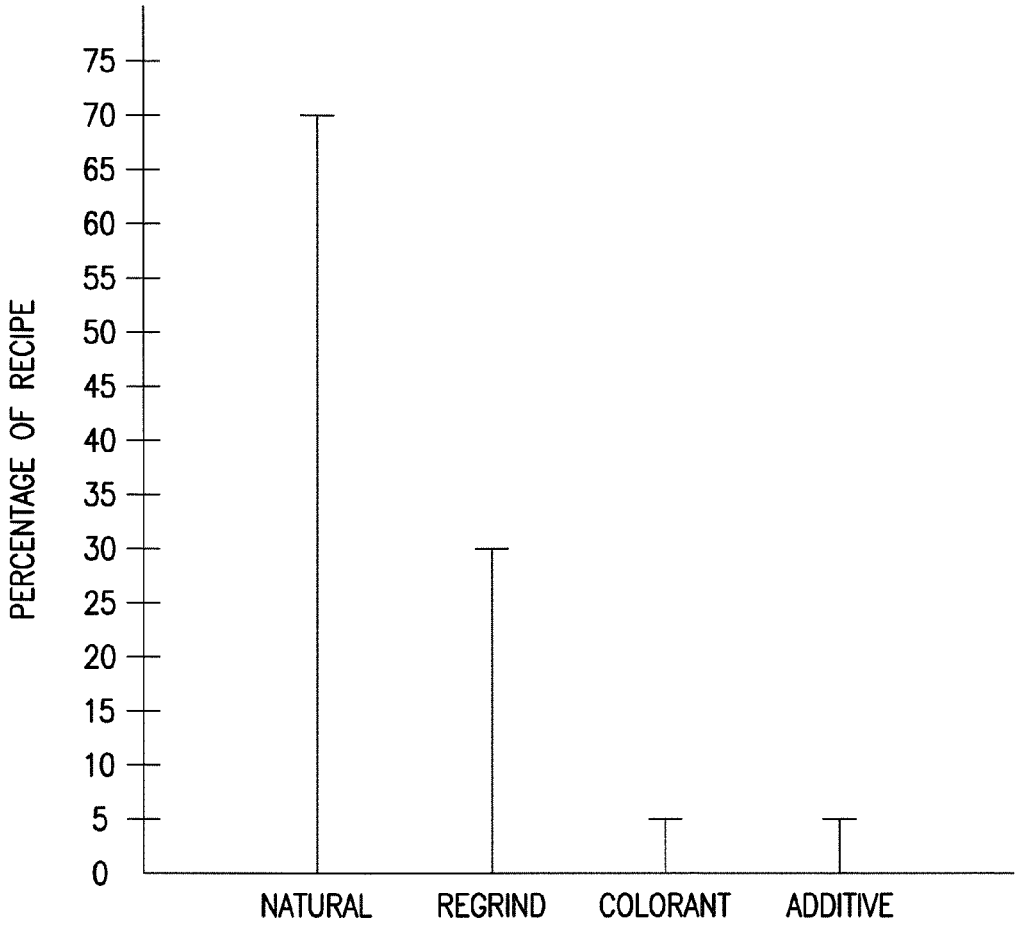
FIG. 2 is a graph illustrating examples of percentages of materials present in a heterogeneous material blended by the material blender of FIG. 1.

Various formulas or recipes for blending these ingredient materials may be used. In one embodiment of the invention, as described herein, the recipe may call for a particular percent by weight, such that each ingredient material makes up a certain percentage of the total weight of the resulting heterogeneous material. For example, as illustrated in FIG. 2, the recipe may call for a value approximately between 10% and 30% by weight of regrind, approximately between 1% to 10% by weight of colorant, and approximately between 1% to 10% by weight of additives, with the natural material making up the balance by weight.

The blending apparatus 12 may be a conventional blender or blending container for blending synthetic resin or other materials, as known to those skilled in the art. Specifically, the blending apparatus 12 may comprise a hopper 26 (or a plurality of hoppers) and a blending chamber 28 in which the materials are blended together. The hopper 26 and/or blending chamber 28 may have one or more inlets 30 formed therethrough for receiving the materials from the delivery system 16 and one or more outlets formed therethrough for dispensing the heterogeneous material after it is blended. The inlets may be configured such that air, pressurized gas, and/or the materials are forced therethrough at a non-perpendicular or non-radial angle, thereby creating a cyclonic action. Advantageously, blending of the materials may be achieved via this cyclonic action. However, other mixing and blending structures for blending the materials prior to delivery of the heterogeneous material to a processing station or bin may also be included as part of the blending apparatus 12. While only four inlets 30 are shown, it is to be understood that fewer than four or more than four inlets may be provided without departing from the scope of the invention.

The control system 14 may include any number or combination of controllers, circuits, integrated circuits, programmable logic devices, computers, processors, microcontrollers, or other control devices, as well as electrical conduits, transceivers, and/or residential or external memory for storing data and other information input by an operator. For example, the control system 14 may include a microprocessor operatively connected to components of the delivery system 16 (as later described herein) via electrical conduits. The residential or external memory may be integral with the control system 14, stand alone memory, or a combination of both. The memory may include, for example, removable and non removable memory elements such as RAM, ROM, flash, magnetic, optical, USB memory devices, and/or other memory elements. The control system 14 and method steps described herein can be implemented in hardware, software, firmware, or a combination thereof.

In some embodiments of the invention, the control system 14 may implement a computer program, executable computer code, and/or code segments to perform some of the functions and method described herein. The computer program may comprise an ordered listing of executable instructions for implementing logical functions in the control system. The computer program can be embodied in any computer-readable medium for use by or in connection with an instruction execution system, apparatus, or device, and execute the instructions. In the context of this application, a "computer-readable medium" can be any means that can contain or store the program for use by or in connection with the instruction execution system, apparatus, or device. The computer-readable medium can be, for example, but not limited to, an electronic, magnetic, optical, electro-magnetic, infrared, or semi-conductor system, apparatus, or device. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

As illustrated in FIG. 1, the control system 14 may also comprise a user interface 62 and a display 64. The user interface 62 may be configured to allow one or more operators to share information with the control system 14. The user interface 62 may comprise one or more functionable inputs such as buttons, switches, scroll wheels, a touch screen associated with the display, voice recognition elements such as a microphone, pointing devices such as mice, touchpads, tracking balls, styluses, a camera such as a digital or film still or video camera, combinations thereof, etc. Further, the user interface 62 may comprise wired or wireless data transfer elements such as a removable memory, data transceivers, etc., to enable the user and other devices or parties to remotely interface with the control system 14. The user interface 62 may also include a speaker for providing audible instructions and feedback.

The display 64 may comprise a graphical interface operable to display visual graphics, images, text, etc. in response to external or internal processes and commands. For example, the display 64 may comprise conventional black and white, monochrome, or color display elements including CRT, TFT, LCD, and/or LED display devices. The display 64 may be integrated with the user interface, such as in embodiments where the display 64 is a touch screen display to enable the user to interact with it by touching or pointing at display areas to provide information to the control system 14. The display 64 may be operable to display various information corresponding to the material blender 10, such as set points or percentages of each of the ingredient materials or information from one or more sensors, as described below.

By way of example only, one suitable controller for use as the control system 14 of the present invention may be provided by Horner APG, LLC of Indianapolis, Ind. as Xle Series OCS with DC/DC and Universal Analog I/O HE-XE105, which is a software-based controller with or without a liquid crystal display (LCD) and/or touch screen options. The control system 14 may be provided with an on-off switch and an optional LCD and/or touch screen or other displays, and may include provisions for setting desired material input amounts. For example, the input amounts may be by weight percentage and may be identified on the display as "natural set point", "regrind set point", "colorant set point", and "additive set point." The control system 14 display 64 may provide these set points as percentages, ratios, and/or decimal values.

As illustrated in FIG. 1, the control system 14 may also comprise and/or be communicably coupled to one or more sensors 60 positioned on or relative to the blending apparatus 12. The sensors 60 may be optical sensors or other sensing devices configured to sense when the hopper 26 or blending chamber 28 is at a maximum and/or minimum fullness. Specifically, one or more of the sensors 60 may be configured to send signals to the control system 14 when material in the hopper 26 or blending chamber 28 is below a minimum threshold, such that the control system 14 is activated to send material to the hopper 26 and/or blending chamber 28. Furthermore, one or more of the sensors 60 may be configured to send signals to the control system 14 when material in the hopper 26 or blending chamber 28 is above a maximum threshold, such that the control system 14 is activated to stop sending material to the hopper 26 and/or blending chamber 28. Additionally, one or more sensors may be configured to determine weight of material output by the blending chamber 28 during calibration and/or verification steps, as later described herein, and to report the weight to the control system 14.

The sensors 60 may be configured to wirelessly send signals to the control system 14 and/or send signals via electrical conduit, fiber optic conduits, or any other method known in the art. By way of example only, one suitable sensor 60 for sensing the material in the blending apparatus 12 may have a male plug connected thereto for connecting the sensor 60 to the control system 14 and is available from Turck, Inc. of Minneapolis, Minn. as Model No. BCF10-S30-RZ3X-2M-WSB3T. The male plug may communicate electrically, optically, and/or wirelessly with a female receptacle, such as receptacle Model Mo. FKB3-0.5/18.25, also from Turck Inc. However, any sensors or male and female receptacles may be used for sensing amounts of material in the blending apparatus 12 without departing from the scope of the invention.

The material delivery system 16, as illustrated in FIG. 1, may comprise various pneumatic conveying elements and flow control elements (e.g., valves) to convey the materials from the respective bins 18-24 to the inlets 30 of the blending apparatus 12. Specifically, the material delivery system 16 may include or be coupled to a pressure source 66, and may further comprise conduits 32,34,36,38, pneumatic accelerators 40, air lines 42,44,46,48, valves 50,52,54,56, on/off controls 58, and/or an air regulator 68.

Figure 3:
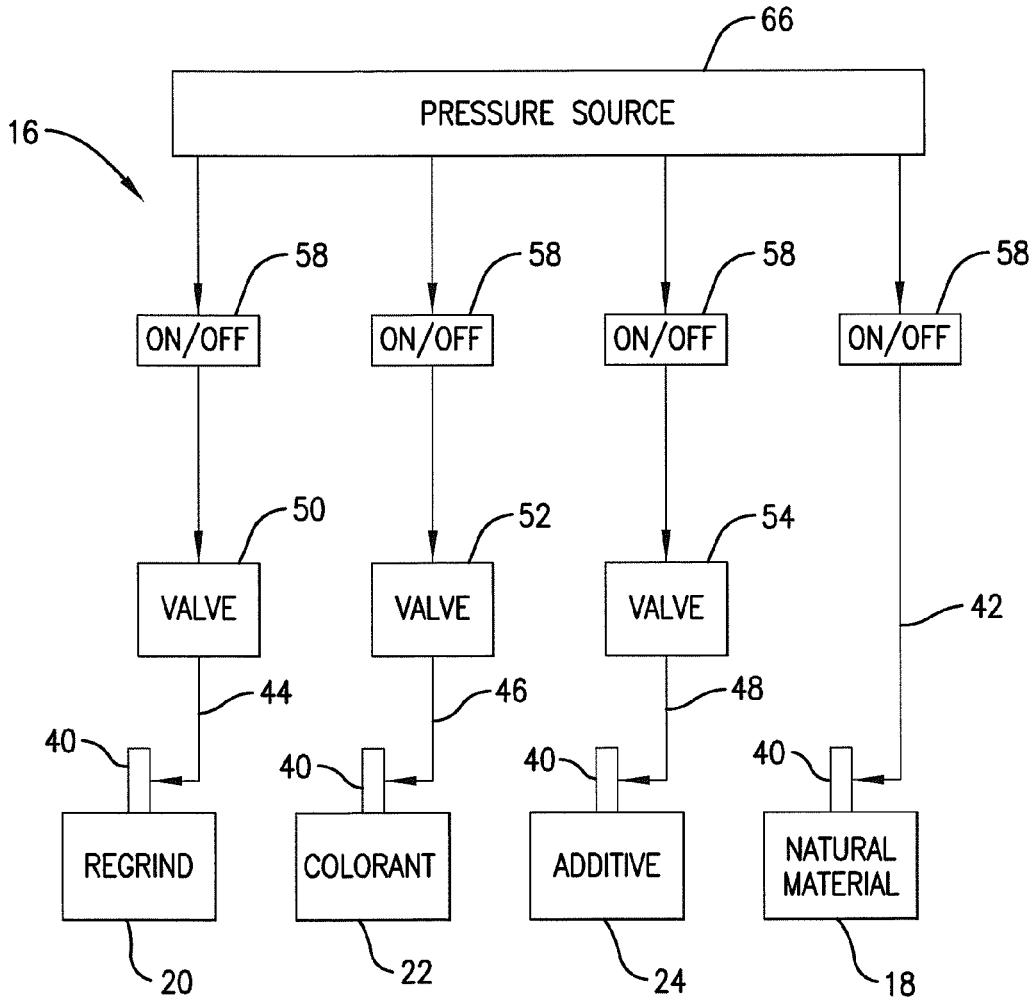
FIG. 3 is a schematic diagram of an alternative embodiment of a delivery system of the material blender of FIG. 1 without an air regulator.
Figure 4:
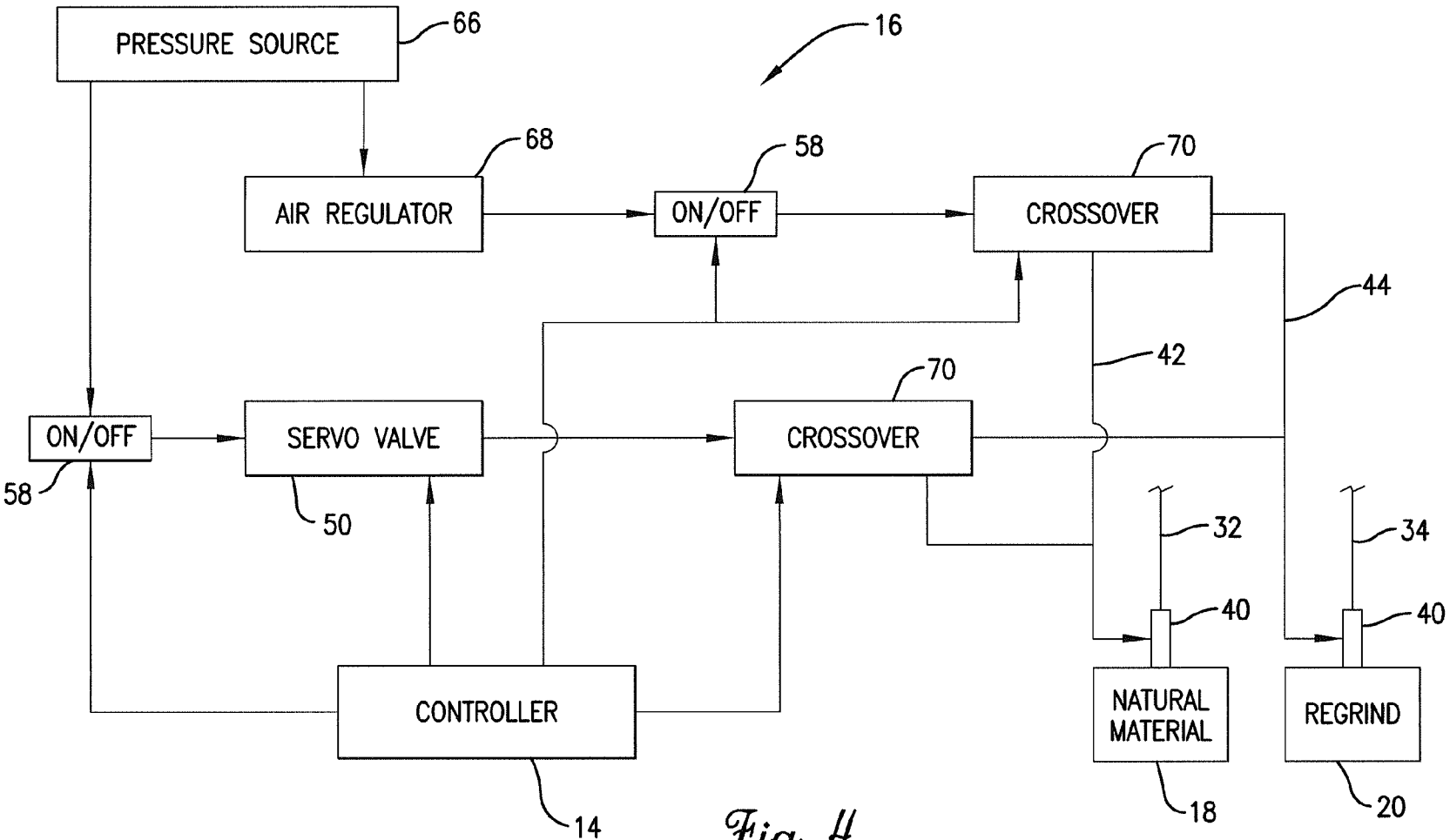
FIG. 4 is a schematic diagram of another alternative embodiment of the delivery system of the material blender of FIG. 1, further comprising crossover electromechanical components.

The pressure source 66, as illustrated in FIGS. 1, 3, and 4, may be any source configured for pumping air or compressed gas throughout the material deliver system 16. For example, the pressure source 66 may be an air compressor or a functionally-equivalent alternative. The pressure source 66 may specifically be configured to provide a pneumatic flow through the air lines 42-48 and pneumatic accelerators 40 via the on/off controls 58, the air regulator 68, and/or the valves 50-56.

The conduits 32-38, as illustrated in FIG. 1, may be flexible pipes or tubes and may connect to respective ones of the inlets 30. Alternatively, the conduits 32-38 may be rigid pipes, tubes, and/or passageways connected to respective ones of the inlets. The conduits 32-38 may be configured to convey the ingredient materials from the bins 18-24 to the blending apparatus 12. The conduits 32-38 may have any dimensions and cross-sectional shape without departing from the scope of the invention.

The pneumatic accelerators 40 may be any pneumatic accelerator, aspirator, venturi eductors, or other venturi systems attached to and/or communicatively coupled with the conduits 32-38 and configured to pull or suction material from the bins 18-24 into their respective conduits 32-38. The pneumatic accelerators 40 may each include material pick-up lances or rigid, elongated inlets configured to be pushed into and/or buried in the ingredient material of one of the bins 18-24. The pneumatic accelerators 40 may each comprise one or more supply inlets for air or compressed gas to be delivered thereto. However, other methods of pushing or pulling the various materials into the conduits 32-38 may be used without departing from the scope of the invention.

The air lines 42-48 may also be flexible or rigid pipes or tubes configured to supply pressurized air or gas from the pressure source 66 to the supply inlets of the pneumatic accelerators 40. One or more of the air lines 42-48 may be integrally and/or communicably coupled to one of the valves 50-56. The air lines 42-48 may have any dimensions and cross-sectional shape without departing from the scope of the invention.

The valves 50-56 may be any valves known in the art, such as electro-pneumatic servo valves, and may be configured to control the flow of air or gas delivered from the pressure source to the pneumatic accelerators 40. The valves 50-56 may also be operable to open by varying extents between an open and a closed position. For example, one or more of the valves 50-56 may be electro-pneumatic servo valves provided by SMC Corporation of America of Noblesville, Ind. as Model No. ITV2050-01N3N4. In some embodiments of the invention, one or more of the valves 50-56 comprises an integral proportional-integral-derivative (PID) controller.

In some embodiments of the invention, one or more of the valves 50-56 may be configured to open by varying degrees anywhere between a fully-shut and fully-open position depending on electrical signals provided thereto by the control system 14. This may allow an oscillation of the amount of pneumatic flow sent through the corresponding pneumatic accelerators 40, thus controlling an amount of one of the materials (e.g., natural, regrind, colorant, or additive) per unit of time provided to the blending apparatus 12. In some embodiments of the invention, it may not be desirable to completely close the valves 50-56 during oscillation. For example, to prevent a complete loss of airflow or pressure in the conduits 32-38 during dispensing of the ingredient materials into the blending apparatus 12, the valves 50-56 may be oscillated or varied between a fully open and partially closed position, thereby maintaining a continual flow of varying intensities.

The term "oscillation" or "oscillating," as described herein, may refer to varying between a minimum valve position and a maximum valve position, as dictated by the control system 14 and/or the valves 50-56. The terms "oscillation rate" or "oscillation speed" as used herein may refer to an amount of time the valve is maintained at its maximum valve position, an amount of time the valve is maintained at its minimum valve position, and/or time intervals for switching between the minimum and maximum valve positions. For example, in one embodiment of the invention, any of the valves 50-56 may be oscillated via the control system 14 by maintaining a consistent amount of time at the maximum valve position, but varying the length of time that the valve is in the minimum valve position. The more time that the valve dwells at the minimum valve position, the less the amount of corresponding ingredient material conveyed to the blending apparatus 12.

Each of the valves 50-56 may comprise and/or be proceeded by an individual on-off control 58 which may function to close or shut-off the flow of air or gas to the valves 50-56, air lines 42-48 and/or pneumatic accelerators 40 when placed in an "off" position. For example, the on-off control 58 may be a solenoid valve or any other discrete valve. Alternatively, any of the on-off controls 58 may be integral with the valves 50-56 or may be omitted without departing from the scope of the invention. In an "on" position, the on-off control 58 may allow pneumatic flow to its corresponding valve 50-56, which may be completely open, oscillated between varying degrees of openness, and/or completely closed. In an "off" position, the on-off control 58 may prevent any pneumatic flow to its corresponding valve 50-56.

In some embodiments of the invention, the material delivery system 16 may also comprise the air regulator 68 into which air may be received via the pressure source 66. For example, the air regulator 68 may be provided by SMC Corporation of America as Model No. AW30-NO3BDE-Z. The air regulator 68 may be any discrete valve, such as a valve configured to cut off the flow of air or gas at certain pressures, thus ensuring a consistent air flow from the pressure source to at least one of the air lines 42-48. However, the air regulator 68 may be omitted from the material blender 10, as illustrated in FIG. 3, without departing from the scope of the invention.

The air regulator 68 may be set at a desired air pressure, for example 30 to 120 psi, or approximately 90 psi. The desired air pressure may be fixed or may be set by an operator. For example, the desired air pressure may correspond to the types and/or amounts of ingredient material to be delivered to the blending apparatus 12. Alternatively, the desired air pressure may be fixed, irregardless of the types of materials being blended.

In some embodiments of the invention, as illustrated in FIG. 1, the air regulator 68 may be used in place of any one of the valves (e.g., valve 56 in FIG. 1). Specifically, as described below, one of the materials may be provided at a substantially constant rate, therefore not requiring the use of electro-pneumatic valves used for a variable pneumatic flow. Rather, one of the on-off controls 58 may be communicably coupled to the air regulator 68 and/or its associated airline 42 to turn flow thereto off or on. For example, valve 56 may be omitted, as illustrated in FIG. 3. In this example, the ingredient material, such as the natural material, is provided a substantially constant pneumatic flow while the other materials mixed with it are provided at a variable rate of pneumatic flow via the electro-pneumatic servo valves 50-54.

In another embodiment of the invention, as illustrated in FIG. 4, one of the electro-pneumatic servo valves (e.g., valve 56) may be omitted, and another of the valves (e.g., valve 50) may be selectively coupled to two or more of the air lines 42-48 via a crossover electromechanical component 70. In general, the crossover electromechanical component 70 may be operable to switch which one of the air lines 42-48 and/or which of one of the pneumatic accelerators 40 receive air or gas directly from the pressure source 66 or air regulator 68 and which receive air or gas flowing through one of the valves 50-54.

For example, two crossover electromechanical components 70 may be included in delivery system 16, as illustrated in FIG. 4. Specifically, a first one of the crossover electromechanical components 70 may receive pneumatic input from the air regulator 68 and/or pressure source 66 and a second one of the crossover electromechanical components 70 may receive pneumatic input from one of the valves 50-54. Additionally, both the first and second ones of the crossover electromechanical components 70 may selectively send pneumatic flow output through the air line 42 and/or through the air line 44. In this example, the crossover electromechanical components 70 may each switch between a first configuration and a second configuration. In the first configuration of the first crossover electromechanical component the pneumatic flow therefrom may be fed to air line 42. In the first configuration of the second crossover electromechanical component, the pneumatic flow therethrough may be fed to air line 44. In the second configuration of the first crossover electromechanical component, the pneumatic flow therethough may be fed to air line 44. In the second configuration of the second crossover electromechanical component, the pneumatic flow therethrough may be fed to air line 42. In some embodiments of the invention, the crossover electro mechanical components 70 may be communicably coupled such that the configuration of one is dependent upon the configuration of the other and vice versa. The mechanical and/or electrical switching of configurations of the crossover electromechanical components 70 may be controlled and actuated via signals output by the control system 14.

In use, the control system 14 may individually actuate the on-off controls 58, air regulator 68, and/or the valves 50-56 to deliver desired quantities of each of the materials (natural, regrind, colorant, and additives) to the blending apparatus 12. The total amount or amount per time segment of each of the ingredient materials pneumatically conveyed may be controlled by varying and/or oscillating the degree of openness of one or more of the valves 50-56 independently. The total amount of each of the ingredient materials, or the amount per time segment required for each of the ingredient materials, may be determined or calculated by the control system 14 based on percentages, ratios, and/or decimal values input by an operator and/or accessed from a memory or database by the control system 14. The percentages, ratios, or decimal values may represent a percent by weight or volume of the total weight or volume of heterogeneous material desired. So, for example, a mixture of only natural material and regrind may include 70% natural material and 30% regrind material.

Specifically, a method of blending ingredient materials using the material blender 10 may comprise the steps of receiving calibration information, accessing or receiving values corresponding to desired amounts, ratios, or percentages of at least one of the ingredient materials, and the determining signals for oscillating at least one of the valves 50-56 based on the desired amount, ratio, or percentage of the corresponding ingredient material and the stored calibration information. The method may also include steps of verifying that an actual amount of one or more of the ingredient materials being conveyed is equal to or within an allowable range of the desired amount of the ingredient material and adjusting a rate of oscillation of the corresponding valve 50-56 if the actual amount is not equal to or within the allowable range of the desired amount. Some or all of these steps may be performed by the control system 14.

Figure 5:
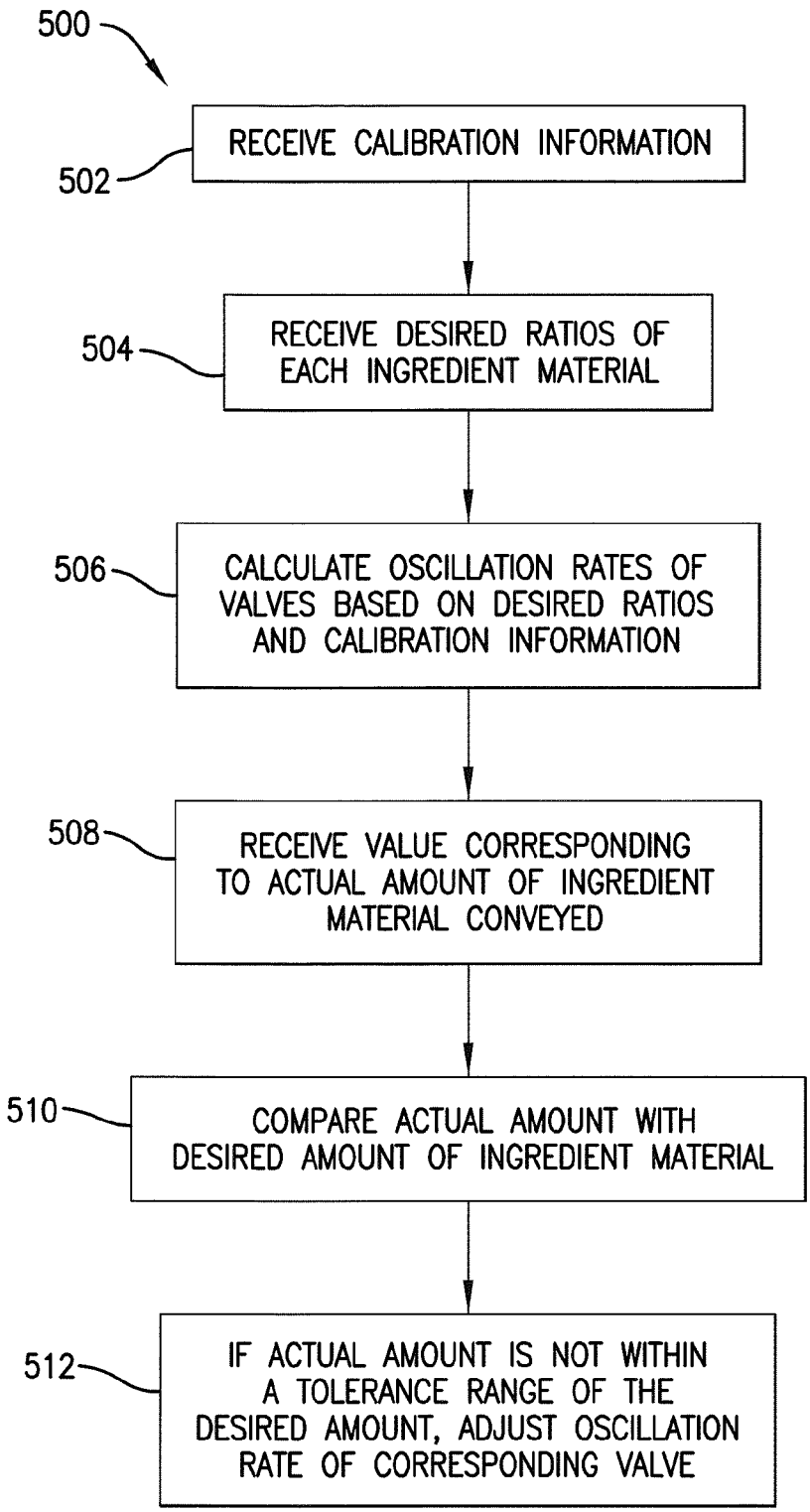
FIG. 5 is a flow chart of method steps for blending materials with the material blender in accordance with embodiments of the present invention.

The flow chart of FIG. 5 depicts the steps of an exemplary method 500 of blending ingredient materials with the material blender 10. In some alternative implementations, the functions noted in the various blocks may occur out of the order depicted in FIG. 5. For example, two blocks shown in succession in FIG. 5 may in fact be executed substantially concurrently, or the blocks may sometimes be executed in the reverse order depending upon the functionality involved.

The method 500, as illustrated in FIG. 5, may include the step of receiving calibration information, as depicted in block 502. Because the natural, regrind, colorant, and additive materials may each have different sized particles and different densities or weight, the control system 14 may need to be calibrated before use. For example, in a first calibration step, the control system 14 may convey natural material from the corresponding bin 18 for a set amount of time (i.e., a control time segment) without varying or oscillating the corresponding pneumatic flow. Specifically, the corresponding valve 56 may be fully open the entire control time segment and/or the input to airline 42 may be directly coupled to the air regulator 68 and/or the pressure source 66, with the corresponding on/off control 58 in the "on" position. Then a user may weigh the natural material conveyed during the control time segment and enter this value into the control system 14. Alternatively, a scale (not shown) with a bin thereon may be placed to receive the material from the outlet of the blending apparatus 12 during calibration, and the weight from the scale may be transmitted wirelessly, electrically, or optically to the control system 14. This weight received by the control system 14 during the first calibration step may be stored therein as part of the calibration information.

Calibrating the control system 14 may further comprise a second calibration step of conveying natural material from the corresponding bin 18 for the control time segment while varying or oscillating one of the valves 50,56 communicably coupled with the corresponding airline 42 and pneumatic accelerator 40. Oscillating the airflow through the corresponding conduit 32 via one of the valves 50,56, as described above, may affect the amount of natural material conveyed during the second calibration step compared with the first calibration step. The resulting weight of the natural material measured during the second calibration step is also stored as part of the calibration information in the control system 14.

Subsequent calibration steps for the natural material may include repeating the second calibration step for several different oscillating rates (e.g., different dwell times for maintaining the associated valve at its minimum valve position) and storing the resulting weight of natural material for each oscillating rate in the control system 14. Typically, the resulting weights will generally decrease as the dwell time for maintaining the associated valve at its minimum valve position increases. Furthermore, the calibrating steps described above may each be repeated individually for each of the conduits 32-38 and corresponding ingredient materials.

For example, the control system 14 may determine the weight of regrind conveyed during the set amount of time when the valve 50 is completely open, when the valve 50 is oscillated at a first speed, and when the valve 50 is oscillated at a second speed which is slower than the first. In some embodiments of the invention, any number of calibration steps may be added to the method described above, with different oscillation rates used for each calibration step performed on each of the valves 50-56 for their corresponding ingredient materials.

Once calibration is completed for each of the ingredient materials, the method 500 may include a step of accessing a recipe from a memory element of the control system 14 and/or receiving values input by the operator, as depicted in block 504. The values accessed or received may correspond to percentages of the total heterogeneous material to be comprised of each of the ingredient materials. For example, the recipe may be 70% natural material, 26% regrind material, 3% colorant material, and 1% additive materials. In some embodiments of the invention, the operator may select an option to save the recipe they input into the control system 14 to be accessed and selected at a later time.

The method 500 may then comprise the step of calculating oscillation rates of at least one of the valves 50-56, as depicted in block 506. Specifically, the oscillation rate of each of the valves 50-54 may be calculated by the control system 14 based on the corresponding percentage or desired amount of the corresponding ingredient material and based on the calibration information obtained for that ingredient material. The control system 14 may then deliver a signal corresponding to this desired amount or percentage to at least some of the valves 50-56, thereby controlling the degree of openness of the valves 50-56 and/or the rate at which the degree of openness is varied or oscillated, as described above. The control system 14 may also receive feedback signals from the sensors 60 corresponding to the amount of material being processed by the blending apparatus 12. The signal provided to the control system 14 from the material sensor 60 may correspond to the total amount of material conveyed from the bins 18-24.

While dispensing any desired quantity or running for any amount of time, as required by the accessed recipe or input by the operator, at least one of the ingredient materials (typically the natural material) may be provided at a constant rate, while the other ingredient materials may be provided at a rate oscillated by the valves 50-56. The oscillation speed of each of the valves 50-56 required for the particular recipe may be calculated by the control system 14 based on the corresponding set-point value or desired percentage associated with the corresponding ingredient material and based on the stored calibration information.

The control system 14 may calculate the desired amount of ingredient material per unit of time or relative to the total amount of heterogeneous material requested via the recipe or operator. If the desired amount is equal to one of the weights of the ingredient material entered during calibration, then the corresponding oscillation rate may be used (i.e., sent to the corresponding valve 50-56 via the control system 14). If the desired amount is not equal to one of the weights of the ingredient material entered during calibration, then a scaling operation may be used to calculate a desired oscillation rate using various scaling methods. Numerous methods of estimating and/or calculating a desired value based on known values (e.g., values obtained via calibration) are known in the art. Specific scaling operations described below are merely examples and are not intended to limit the scope of the invention.

In one embodiment of the invention, the slope of calibration points can be used to determine the oscillation rate required to output the desired amount of ingredient material (total amount or amount per unit of time). For example, if a first weight of regrind material (x1) is output at a first oscillating rate (y1) of the valve 50 during calibration, a second weight of regrind material (x2) is output at a second oscillating rate (y2) of the valve 50 during calibration, and the desired weight (based on the desired percentage input by the operator) of regrind material is half-way between the first weight and the second weight, then the control system 14 may calculate that an oscillating speed half way between the first and second oscillating speeds should be applied to achieve the desired weight of regrind.

So, in graphical or mathematical terms, the slope between x1,y1 and x2,y2 may be used to calculate any "y" value (e.g., oscillation rate for valve 50) for any known desired "x" value (e.g., weight of regrind material). This type of calculation may be used to determine the oscillation rate of any of the valves 50-56 based on calibration values associated with the ingredient materials and valves and an accessed or operator-entered desired amount of ingredient material. As referenced above, oscillation rate may be provided as an amount of time at a maximum valve position, an amount of time at a minimum valve position, and/or an interval of time between switching from one of the valve positions to the other of the valve positions without departing from the scope of the invention.

In some embodiments of the invention, control system 14 may be programmed or commanded to verify that the actual amount of one or more of the ingredient materials being output is accurate, as illustrated in blocks 508-512. Similar to the calibrating steps described above, this verification step may allow output or conveying of only one of the ingredient materials at a time. For example, the operator may select verification that the regrind material conveyed is still resulting in 26% of the total weight of the heterogeneous material. The control system 14 may then output the regrind material for the set length of time (e.g., 30 seconds) at the calculated oscillation speed. The regrind material may then be weighed, and the weight may be input and/or received by the control system 14, as depicted in block 508. This actual weight may be compared with a desired weight, as depicted in block 510, to determine the actual amount or percentage of regrind per unit of time being delivered to the blending apparatus 12.

If a comparison of the actual amount and the desired amount reveals a percentage of error outside of a predetermined range of tolerance (e.g., plus or minus 2 percent), then the verification may be conducted again, with the control system 14 adjusting the oscillation rate up or down, depending on if more or less regrind material is needed to achieve the desired weight, as depicted in block 512. This verification process may be conducted for any of the ingredient materials to test for errors at any point after calibration of the material blender 10. Furthermore, the amount by which the oscillation rate is varied may be scaled based on an amount of error (i.e., larger adjustment steps for larger amounts of error).

Once the ingredient materials from the bins 18-24 are blended, the heterogeneous material may be output directly to another processing machine or a processing station. Alternatively, the heterogeneous material may be transported manually and/or via conveyor, such as pneumatic conveyors, from the blending apparatus 12 to the processing station, such as an extruder or other machines for forming and shaping plastic parts. However, the heterogeneous material may be used for any process following blending by the material blender 10 without departing from the scope of the invention.

EXAMPLE

The following is a specific example of the method 500, as described above, for one of the valves 50-56 associated with the natural material. During oscillation, the valve 50-56 may open to a maximum valve position for a fixed time and then close to a minimum valve position for a variable amount of time. The more time that the valve 50-56 dwells at the minimum valve position, the less natural material provided to the blending apparatus 12. Therefore, the oscillation rate in this example is provided as an amount of time that the valve 50-56 is commanded to dwell at a given minimum valve position.

In the first step of calibration for the virgin material, the control system 14 may command the delivery system 16 to convey the virgin material via the air regulator 68, as in FIG. 4, with its corresponding on-off control 58 in an "on" position for a set amount of time and may then prompt the operator to enter the resulting weight of the natural material output by the delivery system 16. This value may be stored by the control system 14. In the second step of calibration for the virgin material, the control system 14 may command the delivery system 16 to convey the virgin material via one of the valves 50-56 (i.e., valve 50 in FIG. 4) for the set amount of time with a first dwell time set for the minimum valve position. Note that this second calibration step may also require switching the crossover electromechanical components 70 from the first configuration to the second configuration, as described above and illustrated in FIG. 4, such that the input for conveying the natural material is provided via the valve 50. The first dwell time may be substantially small, meaning that the amount of natural material output during the second step may be only slightly less than the amount of natural material output during the first step.

The operator may then be prompted to enter the weight of natural material output during the second step at the first dwell time into the control system 14, to be stored therein. The second step may be performed six additional times, in this example embodiment of the invention, with the dwell time increasing for each repetition, therefore resulting in a smaller amount of natural material output by the delivery system 16 during each subsequent calibration step. The operator may be prompted to enter weights of the natural material output during each calibration step.

Once the calibration for the natural material is complete, the operator may input a desired percentage or amount of natural material into the control system 14. The control system 14 may then compare that desired amount with the amounts measured during calibration. For example, if a desired weight of natural material is greater than a weight measured during the third calibration step and less than a weight measured during the second calibration step, then the dwell time may be scaled relative to the dwell times associated with the third calibration step and the second calibration step to determine an appropriate dwell time to convey the desired weight of natural material.

While natural, regrind, colorant, and additive materials are described and illustrated herein, any variety of materials may be blended using the apparatus and method steps described above. For example, only two types of materials may be blended, or alternatively, five types of materials may be blended using the material blender 10.

Although the invention has been described with reference to the preferred embodiment illustrated in the attached drawing figures, it is noted that equivalents may be employed and substitutions made herein without departing from the scope of the invention as recited in the claims.

Having thus described various embodiments of the invention, what is claimed is as new and desired to be protected by Letters Patent includes the following:

The invention claimed is:

1. A method for automated blending of a plurality of ingredient materials, including at least a first ingredient material and a second ingredient material, to produce a single heterogeneous material, the method comprising the steps of:

receiving or accessing, with a control system, at least one value corresponding to at least one of a desired weight ratio of the first ingredient material and a desired weight ratio of the second ingredient material to be blended;

pneumatically conveying the first ingredient material to a blending apparatus at a substantially constant rate via an air or gas pressure source fluidly coupled with a first pneumatic accelerator or first venturi device configured for pulling the first ingredient material into a first conduit fluidly coupled with the blending apparatus;

sending a signal to a servo valve commanding the servo valve to oscillate at a rate corresponding to the desired weight ratio of the second ingredient, wherein the servo valve is fluidly coupled with the air or gas pressure source and a second pneumatic accelerator or second venturi device configured for puling the second ingredient material into a second conduit fluidly coupled with the blending apparatus; and pneumatically conveying the second ingredient material to the blending apparatus while oscillating a pneumatic gas or air flow therein by oscillating the servo valve at the rate corresponding to the desired weight ratio of the second ingredient.

2. The method of claim 1, wherein the oscillating of the servo valve includes oscillating the servo valve between differing degrees of partial openness.

3. The method of claim 1, wherein oscillating the servo valve includes oscillating an electro pneumatic servo valve.

4. The method of claim 1, further comprising calibrating the control system by receiving and storing therein values associated with weights of each of the ingredient materials individually output during a set amount of time when pneumatically conveyed: without oscillating the servo valve, while oscillating the servo valve by a first amount, and while oscillating the servo valve by a second amount.

5. The method of claim 4, further comprising determining, with the control system, the amount of oscillation of the servo valve required to output an amount of the second ingredient material corresponding to the desired weight ratio based on the weights of the second ingredient material received during the step of calibrating the control system.

6. The method of claim 1, wherein the steps of pneumatically conveying the first and second ingredient materials further comprises pneumatically conveying the first and second ingredient materials in the form of dry granulated or pelletized material to the blending apparatus.

7. The method of claim 1, further comprising providing air or gas flow from the air or gas pressure source at a continuous rate to a first inlet of a crossover electromechanical component and providing oscillating air or gas flow via the servo valve to a second inlet of the crossover electromechanical component, wherein a first outlet of the crossover electromechanical component is fluidly coupled with the first pneumatic accelerator or first venturi device and a second outlet of the crossover electromechanical component is fluidly coupled with the second pneumatic accelerator or second venturi device, wherein the crossover electromechanical component is actuatable between a first position, in which air or gas flowing at the continuous rate into the first inlet is output through the first outlet and oscillating air or gas flowing into the second inlet is output through the second outlet, and a second position in which air or gas flowing at the continuous rate into the first inlet is output through the second outlet and oscillating air or gas flowing into the second inlet is output through the first outlet, the method further comprising actuating the crossover electromechanical component from the first position to the second position automatically depending on the desired weight ratios of the first ingredient material and the second ingredient material.

8. The method of claim 1, further comprising the steps of:

receiving a value, with the control system, corresponding to an actual amount or ratio of the first or second ingredient material pneumatically conveyed to the blending apparatus;

comparing, with the control system, the actual amount or ratio to a desired amount or the desired weight ratio of the first or second ingredient material; and adjusting, with the control system, the rate of oscillating servo valve if the actual amount or ratio is not within a tolerance range of the desired amount or the desired weight ratio.

9. A method for automated blending of a plurality of ingredient materials, including at least a first ingredient material and a second ingredient material, to produce a single heterogeneous material, the method comprising the steps of:

receiving or accessing, with a control system, at least one value corresponding to at least one of a desired weight ratio of the first ingredient material and a desired weight ratio of the second ingredient material to be blended;

pneumatically conveying the first ingredient material to a blending apparatus at a substantially constant rate by fluidly coupling an air or gas pressure source with a first pneumatic accelerator or first venturi device configured for pulling the first ingredient material into a first conduit fluidly coupled with a first one of a plurality of inlets of the blending apparatus, wherein each of the inlets of the blending apparatus are formed at tangential, non-radial, or non- perpendicular angles relative to the blending apparatus, such that air or gas forced through the inlets create a cyclone-like flow within the blending apparatus; and pneumatically conveying the second ingredient material to a second one of the plurality of inlets of the blending apparatus while oscillating a pneumatic gas or air flow therein by oscillating an electro pneumatic servo valve between an open or partially open position and a partially closed position at a rate corresponding to the desired weight ratio of the second ingredient, wherein the electro pneumatic servo valve is fluidly coupled with the air or gas pressure source and a second pneumatic accelerator or second venturi device configured for pulling the second ingredient material into a second conduit fluidly coupled with the second one of the plurality of inlets of the blending apparatus.

10. The method of claim 9, further comprising calibrating the control system by receiving and storing therein values associated with weights of each of the ingredient materials individually output during a set amount of time when pneumatically conveyed:

without oscillating the pneumatic flow, while oscillating the pneumatic flow by a first amount, and while oscillating the pneumatic flow by a second amount.

* * * * *